United States Patent [19]

Freuler

[11] 4,194,275

[45] Mar. 25, 1980

[54] SPREADER ROLL

[76] Inventor: Fred H. Freuler, Bännlistrasse, Riedholz, Switzerland

[21] Appl. No.: 829,906

[22] Filed: Sep. 1, 1977

[30] Foreign Application Priority Data

Sep. 10, 1976 [CH] Switzerland ..... 11532/76

[51] Int. Cl.[2] ..... D06C 3/06

[52] U.S. Cl. ..... 26/100

[58] Field of Search ..... 26/99, 100

[56] References Cited

U.S. PATENT DOCUMENTS

| | | | |
|---|---|---|---|
| 258,947 | 6/1882 | Upham et al. | 26/100 |
| 2,289,796 | 7/1942 | Meyer | 26/100 X |
| 3,344,493 | 10/1967 | Telgheider | 26/99 |

FOREIGN PATENT DOCUMENTS

| | | | |
|---|---|---|---|
| 729048 | 3/1966 | Canada | 26/99 |
| 706195 | 5/1941 | Fed. Rep. of Germany | 26/100 |
| 917304 | 8/1954 | Fed. Rep. of Germany | 26/100 |
| 348003 | 1/1907 | France | 26/100 |
| 1122 | of 1858 | United Kingdom | 26/100 |
| 20280 | of 1890 | United Kingdom | 26/100 |
| 1333076 | 10/1973 | United Kingdom | 26/100 |

*Primary Examiner*—Robert Mackey

*Attorney, Agent, or Firm*—Roylance, Abrams, Berdo & Farley

[57] ABSTRACT

A spreader roll for web processing machines used in the paper, textile, and plastic industry. The roll has a stationary shaft on which a roll structure is rotatably mounted. A plurality of rigid cylinder segments form the surface of the roll structure. The cylinder segments are connected to each other movably in relation to each other and to the roll body. The cylinder segments are arranged about, and rotated together with a cylinder sleeve and are connected to each other cicumferentially through rigid retaining rings encircling the roll sleeve. The retaining rings oppose the displacement of the cylinder segments through centrifugal forces acting in the radial direction. The cylinder segments are arranged in parallel rows along the cylinder axis and interconnected to each other within the rows. Annular carriages within the roll structure rotate as integral parts of the roll and at angles to the roll-axis. Thereby, the cylinder segments are caused with each revolution to be progressively elongated and then contracted.

7 Claims, 16 Drawing Figures

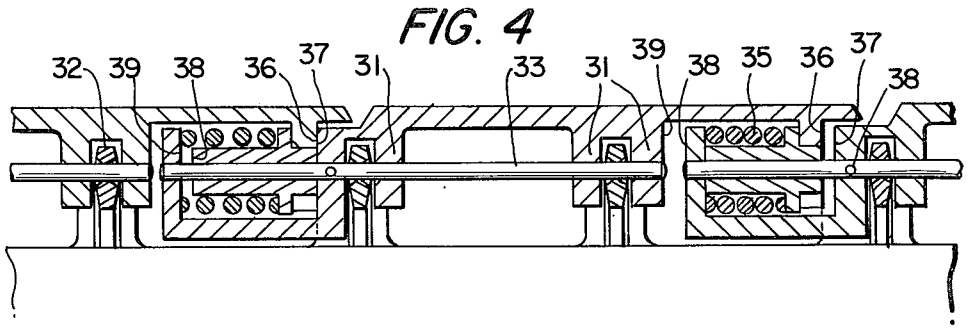
FIG. 4
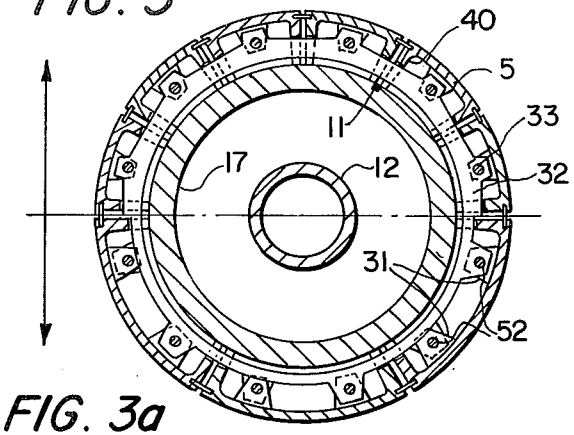
FIG. 3
FIG. 3a
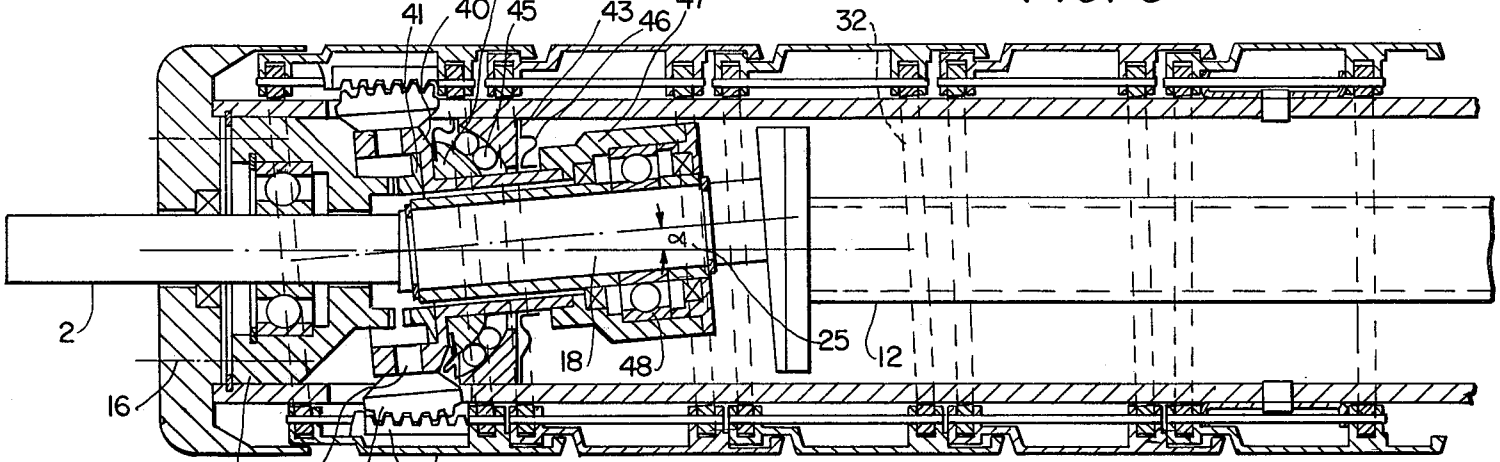
FIG. 5

SPREADER ROLL

BACKGROUND OF THE INVENTION

This invention relates to spreader rolls, in particular to a new and improved device of this general class which consists of a rigid, straight cylindrical sleeve rotatably mounted coaxially on a stationary supporting shaft, the sleeve surface being made up of a multitude of rigid cylinder elements which are movably connected to each other, to be used on machines for the manufacture of web materials such as paper, plastics, textiles, etc.

In the manufacture of paper, plastic, or textile material, the formation in the web of wrinkles or folds that run longitudinally in the direction of travel is an ever-present problem. They are caused by various forces acting upon the web while it is being processed. The forces originate form misalignments in the machinery, non-uniformities in the make-up of the web-material, or other process variations. Such wrinkles and folds in the processed webs will usually cause operational difficulties and quality deficiencies in the finished products. Therefore, special devices at regular intervals are required on web manufacturing machines to prevent or remove such wrinkles and folds. It follows that for better uniformity these devices are with very few exceptions made to constitute rotating rolls which support and effect the entire width of the webs.

Besides the prevention and elimination of wrinkles or folds in the web, the spreading forces exerted by the roll upon the web while it is being processed will in many cases result in improved physical properties of the web product. In particular the cross-machine tension forces put to a web while being processed will tend to equalize the physical properties present in the machine direction on the one hand and in the cross-machine direction on the other, resulting in an overall improvement of the web qualities. In paper, for instance, repeated cross-machine stretching during the drying phase will increase the cross-machine tensile strength substantially, to a value which can approach the otherwise highly accentuated machine-direction tensile-strength.

A spreader roll of the straight cylindrical type has been made known thru U.S. Pat. No. 3,344,493. This design embodies a rigid cylindrical sleeve rotatably mounted on a stationary shaft with the shell made up of a plurality of closely spaced and longitudinally arranged elastic bar elements.

This design of a straight cylindrical spreader roll when applied to wide webs has the disadvantage of producing a spreading action which is non-uniform over the width of the machine. This is caused by the friction forces generated between the sliding surfaces of elastic bars and supporting inner tube which is counteracting the cyclical expansion/contraction movements of the bars. The restrictive friction-forces accumulate from the non-sliding mid-point of the roll length toward the roll ends and, therefore, result in a spreading action which is considerably greater on the roll edges than it is in the mid-section, where the spreading movements can come to a full stand-still under demanding conditions.

The present invention has as its objective to provide a marked improvement in the design of straight cylindrical spreader rolls.

BRIEF SUMMARY OF THE INVENTION

This objective is accomplished by the present invention of a spreader roll. The roll embodies an arrangement of closely spaced cylinder elements around a rotatable rigid cylindrical sleeve. The cylinder elements are held together in full circles by rigid rings, thereby presenting a substantially continuous cylindrical exterior roll surface. The longitudinally arranged cylinder elements are interconnected to each other in rows parallel to the roll axis. The opposite ends of rows or intermediate segments are anchored to annular carriages which rotate as integral parts of, and within, the roll structure angularly disposed to the roll axis and thus during each revolution cause every one of the cylinder segment rows to be progressively elongated and then contracted.

These and other objects of the invention and the features and details of construction and operation thereof are hereinafter set forth and described and shown in the accompanying drawings, in which:

BRIEF DESCRIPTION OF THE DRAWINGS

FIG. 3 is a cross-sectional view perpenticular to the roll axis, with the cylinder-segments anchored at two points.

FIG. 3*a* is a cross sectional view similar to FIG. 3, with the cylinder-segments anchored at four points.

FIG. 4 is an enlarged fragmentary longitudinal section of the cylinder-segments contained in FIG. 2.

FIG. 5 is a fragmentary longitudinal section similar to FIG. 2, but showing an alternate construction and arrangement.

DESCRIPTION OF THE PREFERRED EMBODIMENTS

Figure 1:
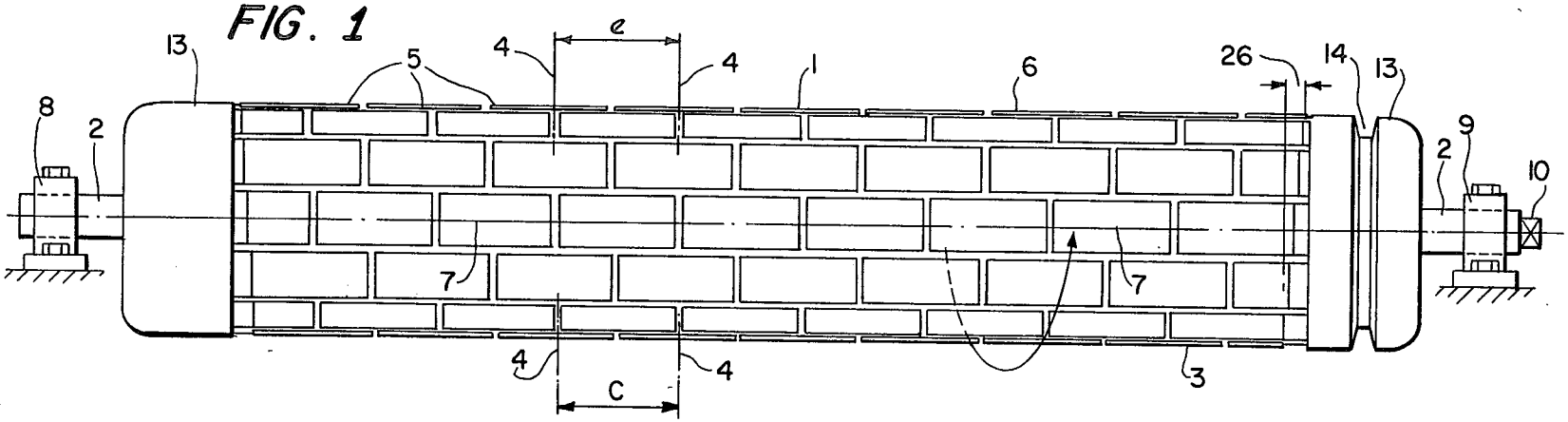
FIG. 1 is a front elevational view showing a spreader roll embodying the present invention.

FIG. 1 is a front elevational view showing a spreader roll embodying the present invention. In this drawing, the spreader roll 1 is shown with the position of maximum longitudinal contraction of the cylinder-segment rows 5 to be in the bottommost position 3. This position of maximum longitudinal contraction of the cylinder-element rows can be adjusted simply by rotating the stationary shaft 2 the required amount and setting it at the desired angular position. The distance between the center-lines of two longitudinally adjacent cylinder-segments in the position of maximum contraction is marked with "C". In the topmost position 6 of FIG. 1 and directly opposite to the position of maximum contraction, the cylinder-segment rows 5 are shown to have progressed to their maximum expansion, which is made visible in distance "e" between two longitudinally adjacent cylinder segments. In the mid-position 7 and directly in front of the viewer, the cylinder-segment rows 5 are in the position of maximum rate of longitudinal movement.

These lateral movements of the cylinder-segments follow the curve of what is called in mathematics an angular simple harmonic motion. At the extreme positions 3 and 6 the sine curve of this harmonic motion reverses its direction and at these points the angle between the tangent of the curve and a line parallel to the direction of travel becomes zero. At the midpoint 7, halfway between the positions of maximum contraction and maximum expansion, the angle between a tangent to the curve of motion and the line of travel is at its maximum, meaning that the momentary rate of expansion at this position of a roll in operation is at its maximum also. If the spreading effect of a spreader roll of this invention to a web must be at its maximum, it is required that the web is brought in roll contact at this mid-point position 7 of the maximum expansion rate. In actual installations, where the web-tension is controlled in a satisfactory manner, a total web contact angle of 10° has proved to be sufficient for proper operation, with 5° before and 5° after the mid-point position 7 being preferable.

The stationary thru-shaft 2, which is supported by pads 8,9 on either end, serves to vary and fix the positions of maximum expansion and contraction by advancing or retracting such maximum positions relative to the travelling web, according to the particular requirements of an operation. This adjustment can be accomplished by simply loosening the bolts of the pad-clamps 8 and 9 and rotating the shaft 2 the required direction and amount to relocate the position of maximum elongation in the desired location relative to the web contact area. To facilitate such readjustment, the shaft 2 has here been provided with a square head 10 at one shaft-end.

Instead of pads 8 and 9 with clamps, worm-gear units can also be used advantageously at this position. The shaft 2 will then pass thru, and be carried by, the gear part of the unit, and the worm serves to fine adjust and fix the rotational roll positions.

For expediency in manufacture, the stationary inner shaft 2 is made in three sections. The end sections 18 are designed to accommodate the bearing elements 15,24; they are joined together by an intermidiate connecting shaft 12. Thus, in manufacturing it is possible to use identical end sections 18 for spreader rolls of different axial length, with the intermediate connecting shaft 12 made especially to take up the length variations of specific dimensional requirements. The endcaps 13 are provided to protect the inner mechanical parts against dirt and mechanical damage. They can be made with grooves 14 to permit driving the spreader rolls by belts on applications where this is desirable. It is to be noted that the spreader roll of this invention is in the form of an idler roll, and thus must be driven by the travelling web or other means.

Figure 2:
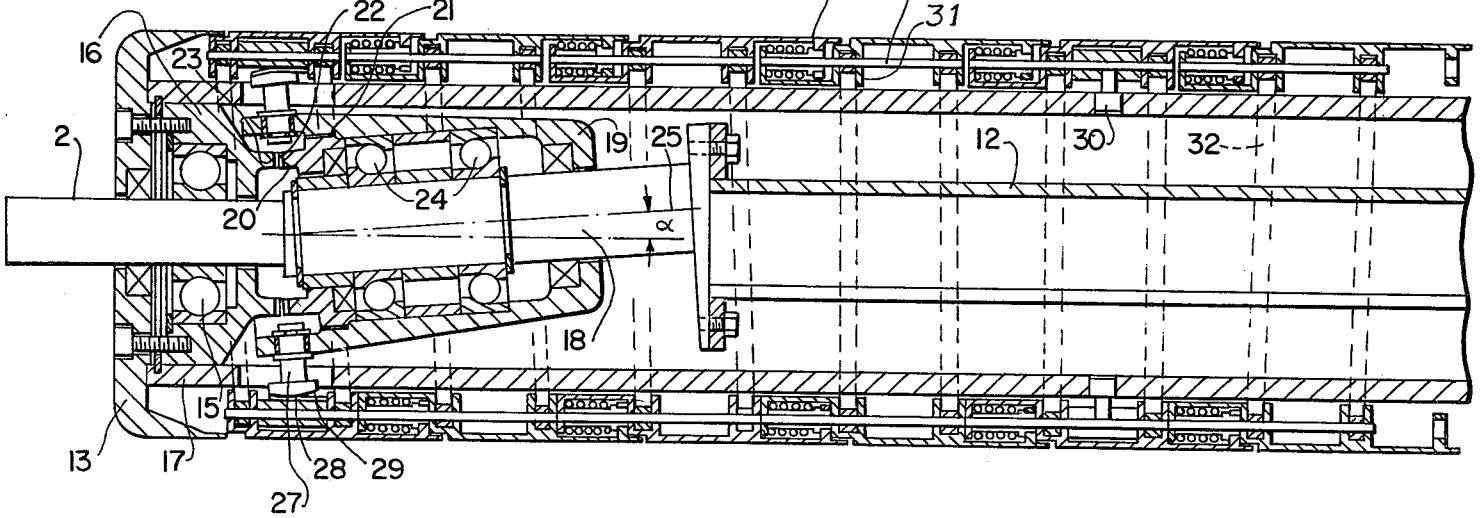
FIG. 2 is an enlarged fragmentary longitudinal section constituting an embodiment of the present invention.

FIG. 2 is an enlarged fragmentary longitudinal section of an embodiment of this invention. Mounted on each end-section 18 of the shaft is the bearing assembly, comprising an anti-friction bearing assembly and annular carriage 16 which is secured interiorly of the cylinder sleeve 17. The pair of annular carriages 19, to which each row of cylinder elements is anchored, are mounted to rotate respectively about axes angularly disposed to each other and to the shaft 2, so that as rotation occurs, each row of cylinder elements is progressively expanded to a maximum when it is in the topmost position of FIG. 1 and 2 and then is progressively moved together closer to a maximum contraction in the bottommost position thereof. The annular carriages 19 are rotably mounted on anti-friction bearings 24, which are held in place by a ring member 20 whose threaded section 21 is engaged with an interior thread cut into the annular carriages 19. A pin thru this threaded connection prevents the parts from becoming disjoined. To maintain unison of rotation of the cylinder sleeve 17 on the one hand and the annular carriages 16 on the other, the two parts are engaged with each other thru a mating pair of bevel gears 22, the two gears having the same number of teeth.

The annular carriage 19 and the bearing assemblies 24 are imposed by the inertia forces of the oscillating cylinder segments and the forces of spring-pretension which act upon the cylinder-segment rows. The dynamic thrust load resulting from these forces is taken fully by the anti-friction bearings 24. The total movement between the positions of maximum extension and maximum contraction, which is the degree of spreading, is given by the three dimensions: angle of tilt 25, diameter of roll 1 and length of cylinder-segment rows 5. The anchoring points located on the annular carriages 19 undergo a wobbling type motion during each revolution, and special care has to be taken to build into the connecting members between annular carriages 19 and cylinder elements ends 5 the flexibility required to permit a swinging motion in radial direction and at the same time an oscillating rotating motion around the anchor points. In FIG. 2, this objective is accomplished by having the pins 27 rotably mounted with anti-friction bearings on the annular carriages 19, while a swinging motion is provided for by coupling the pins 27 to the cylinder segment ends by means of flexible leaf springs 28. The leaf springs 28 are riveted to the cylindrical outside surface 29 of the pin heads on one end and riveted to the inner side of follower blocks on the other end. The follower blocks in turn are fitted into the recessed inside of the cylinder element ends and held engaged by the pins 33 thereof. During operation, the leaf springs 28 will cyclically bend and unbend in the space confined between the curved pinhead surface 29 and the follower block, while transmitting the dynamic forces between annular carriages 19 and the oscillating cylinder elements.

To insure an absolute symmetry of the lateral displacements about the center of the roll length, the cylinder elements located at this center are fixed to the cylinder sleeve 17 by the pins 30.

FIGS. 3 and 3*a* show fragmentary cross sections thru a form of spreader roll construction as illustrated in FIG. 2. It is to be noted that the circumferential width and circumferential pitch are standardized for expediency of manufacture, but are not fixed to any size and number, respectively. However, a circumferential pitch of between six and twelve is preferable. A pitch of less than four is not feasible for the intended purpose of spreading, while a pitch of more than twelve is feasible for spreading but, except for special applications, not practical for cost reasons. In FIG. 3 (the top half of the drawing), the cylindrical elements shown are of narrow-width and are arranged twelve to the full circumference. Each individual cylindrical element of this size is attached with one pin 33 to two rigid retaining rings 32. The pins 33 are located inside, and at the approximate center of, the cylindrical elements. In FIG. 3*a* (the lower half of the drawing) the cylindrical elements shown are of greater width circumferentially and are arranged six to the full circumference. Each individual cylindrical element of this size is attached with two pins 52 to four rigid retaining rings 32. The pins 52 are located inside, and at the approximate quarter points, of the cylindrical elements. Each retaining ring 32 is connected to only one pair of lugs 31. Were two or more anchorage points per one segment 5 be located on the same retaining ring 32, undesirable sliding friction and mechanical jamming of the retaining rings 32 on the pins 33 would be the result. This is because of the swinging motion during operation of the retaining rings 32 and the resulting misalignments in relation to a fixed distance between two pins mounted on the same segments.

In FIG. 4, the anchorage of the segments 5 on the retaining rings 32 is shown in an enlarged longitudinal sectional view. As previously stated, the surface of the spreader roll embodying the present invention comprises a plurality of cylindrical segments 5 longitudinally disposed in spaced, parallel rows about the outer surface of the cylindrical sleeve 17, with the segments at the same time aligned in the direction of travel and held together circumferentially with retaining rings 32. The inside of the individual cylindrical segments are provided with two or more pairs of lugs with holes fitted for pins 33. The retaining rings 32 are preferably made of rigid metal, and can be made in one-piece or sectionalized and put together from rigid links. Holes are provided concentrically at the appropriate pitch around the circumference in the retaining rings. During assembly, the segments are slid over the loosely arranged retaining rings 32, with the rings being straddled by the pairs of lugs 31. The segments are then connected to the retaining rings 32 by pins 33 pushed thru the ring-and-lug combination. The pins 33 are secured against disengagement thru a locking wire 34. FIG. 4 illustrates a first form of a cylinder segment construction 5 embodied in this invention. The forces imposed by the pretensioned segment rows and the inertias of the segments in oscillating motion are here transmitted entirely thru the bodies of the cylinder segments 5. Precompressed compression springs 35 are placed in inside recesses of the segment bodies. The springs 35 exert a longitudinal contracting force upon the segment row assemblies. The total movements of the cylinder segments 5 in relation to each other are limited to a preset range. The stops 36 and 37 control the movements of the cylinder segments in the contraction phase, and the stops 38 and 39 control the movements in the expansion phase.

Also shown on FIG. 4 are further details of the segment-to-retaining-ring attachments. As described previously, during operation, the retaining rings 32 swing back and forth cyclicly in relation to the segments 5. To eliminate a serious source of friction and undue mechanical wear, special care has been taken to properly seat the retaining rings 32 on the pins 33. This is accomplished with the provision of swivel bearings at these locations. The holes of the retaining rings 32, serving here as bearing-sleeves, are either shaped into an inverted spherical profile with the inserted pins 33 having a smooth and straight cylindrical surface (FIG. 4); or, in a second form (FIG. 8), the pins are shaped spherical at the points of bearing and the bearing holes of the retaining rings 32 are made straight cylindrical.

The retaining rings 32 (FIGS. 3, 3*a*), which are preferably made out of a rigid metal, have the required holes for the anchorage of the pins 33 arranged concentrically and at the appropriate pitch around the full circumference. To better clear the inside structure of the cylindrical segments 5, the outside edge of the retaining rings 32 are contoured, with the areas surrounding the anchorage holes shaped into lugs which reach into the recessed inside of the cylinder segments.

FIG. 5 is a fragmentary longitudinal sectional view of a second form of spreader roll embodied in this invention. Since certain elements of the roll are similar in structure and purpose and have been described in connection with the previous forms of rolls (FIGS. 1 to 4), the following description will be directed specifically to the modified elements.

As already illustrated in FIG. 2, the annular carriage 40 has attached to it a bevel gear 41 which is engaged with a mating bevel gear provided for, and part of, the rotatable annular bearing housing 42, which supports the cylindrical sleeve 17 and rotates about the axis of shaft 2. The two meshed gears 41 and 42 have the same number of teeth, which causes the annular carriage 40 to rotate in unison with the sleeve 17. Axial thrust imposed by the pretensioned cylinder-segment rows, and the dynamic inertia forces of the oscillating cylinder segments is taken here by a spherical ball bearing 43, 44, 45. Since the inner race 44 and the outer race 43 of this bearing rotate in unison with respect to their principle axes, the bearing 43, 44, 45 is only subject to a swivelling motion, with the ball bearings 45 moving on a small circular path during a full revolution of the spreader roll. This arrangement results in a substantially lower frictional load to be overcome while the roll is operating, compared to a standard anti-friction thrust bearing 24 shown in FIG. 2. Bellow-seals 46 are attached to inner bearing-races 43 and outer bearing-races 45 to retain lubricants and prevent dirt and other foreign materials from entering. The annular carriage 40 rotates about the shaft-portion 18, which is tilted with respect to the shaft 2. This tilt, or angular disposition of the rotating annular carriage 40, 47, is maintained by having the annular carriages 40 supported at the ends opposite to the spherical bearing 43, 44, 45 rotably supported on an anti-friction bearing 48, which is seated on the tilted shaft-portion 18. The load to be supported by this bearing is in radial direction only and is a minor fraction of the thrust load imposed on the thrust bearing 45.

The transmission of the oscillating motion from the annular carriages 40, 47 to the cylinder segments is here accomplished thru the use of gear segments 49 which form the heads of pins 50. The pins 50 are then firmly held in the annular carriage 40 and locked in place by tapered pins. The teeth of the gear segments 49 are cut spherically, and they mesh with mating gear rack follower blocks 51 which are locked with pins 33 in the recessed inside space of the opposite end segments 5 of each longitudinal segment-row. The spherical tooth-cut of the gear segment teeth 49 is required to permit unrestrained rolling motion between segments 49 and gear racks 51 while the gear segments, together with the annular carriages 40, 47, go thru a wobbling motion during each revolution. The cylinder segments 5 are shown in a second form of embodiment of this invention. Here, the longitudinally adjacent segments 5 are engaged to each other without the use of springs 35 (FIG. 4). The uniformity of motion of the individual segments and the uniformity of the spaces between longitudinally adjacent segments 5 is fully controlled by the interaction of movement stops that come to bear at the maximum expansion position and the maximum contraction position, respectively, and by the longitudinal steering action imposed by the retaining rings 32 upon the otherwise unrestrained floating cylinder segments while on the intermediate paths between the defined extreme positions. Assiting the retaining rings in maintaining the thus enforced tilting angles are the inertia forces born with the rotating rings which, true to the laws of physics, seek to maintain a fixed position of the rotational axes. The angle of tilt of the retaining rings 32 connected to the opposite end-segments of the segment rows is the same as the tilting angle 25 of the annular carriage 40, 47. The tilting angle of the two, four or more retaining rings 32 used in a group to hold one circumferential set of cylinder segments in a ring rotate in parallel planes respective to each other. The tilting angles of the retaining rings change from one circumferential set of cylinder segments to the next, and they become progressively smaller from the opposite ends of the segment-rows toward the center of the roll length, where the tilting angle is zero.

Figure 6:
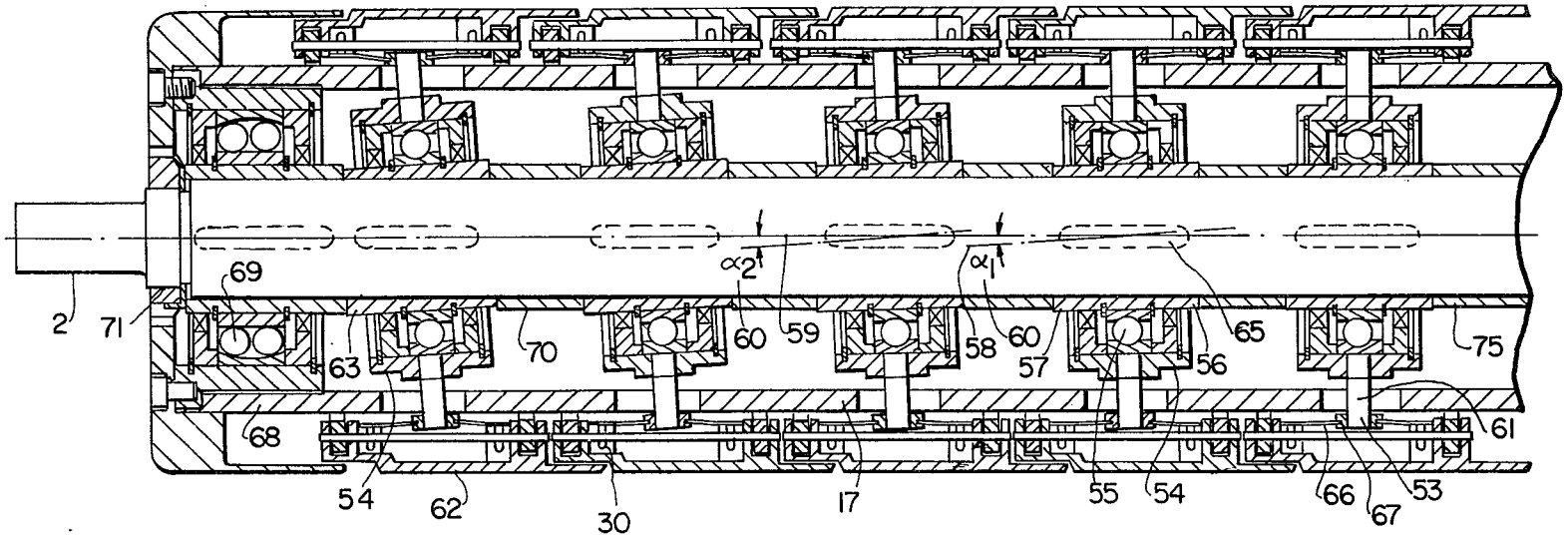
FIG. 6 is a fragmentary longitudinal section similar to FIG. 5, but showing a further alternate construction and arrangement.

FIG. 6 shows a still further form of spreader roll embodied in this invention. In this construction, each cylindrical segment, 62 corresponding to segments 5 in the previously described embodiments, is individually subjected to an oscillating motion by coupling elements 53, 67, 66, which reach from the annular carriage 54 thru openings provided in the sleeve 17 onto the cylinder segments 62. Individual annular carriages 54 control the oscillating motion of the groups of segments making up one ring of segments. Typically the annular carriages 54 are individually rotatably mounted with anti-friction bearings 55 on inner bearing sleeves 57. The axis 58 of the outer cylindrical surface of the bearing sleeves 57 and the axis 59 of the inner bore of the bearing sleeves 57, identical to the axis of shaft 2, are angularly disposed as indicated at 60 to each other at angles $\alpha$, $\alpha_2$, respectively. This angle of disposition decreases progressively from one annular carriage to the other at equal rates from the opposite roll-end positions, where it is at its maximum, toward the center of the roll length, where it is zero. Keys fitted between sleeves 57 and shaft 2 secure the sleeves 57 in the correct rotational position relative to the shaft 2.

The coupling elements 53, 67, 66 which transmit the oscillating longitudinal motion to the cylinder segments specifically comprise pins 53 which are firmly mounted on the annular carriages 54 with a threaded screw connection, bearings 67, in which the outer end of the pins 53 rotably slide, and leafsprings 66 to which the bearings 67 are attached. Pins 31 are fitted to the opposite ends of the leaf springs 66, which reach into hollows provided for them on the inside of the cylinder segments 62. As stated previously, the transformation of the wobbling motion of the annular carriages 54 into linear oscillating motion of the cylinder segments 62 requires flexible coupling means at these points which will, within limits, allow freedom of angular swinging and of rotation. This is accomplished with the construction illustrated. Unison of rotation between angular carriages 54 and sleeve 68 is here brought about by the sliding engagement between bearing surfaces provided for on the pins 53 and the sides of the slots where the pins 33 pass thru the sleeve 68.

The roll sleeve 17 is similarly rotatably mounted on the shaft 2, as described in the previously mentioned forms. At its inner opposite ends, the sleeve 17 terminates in cylindrical housings 68, in which is secured the anti-friction bearing 69. All inner bearing sleeves 56, 63, as well as spacer sleeves 70 and the inner sleeves carrying the sleeve bearings 69, are held tight on the shaft 2 by threaded nut-and-screw connection 71 located on the shaft 2 at the opposite inner roll ends.

Figure 7:
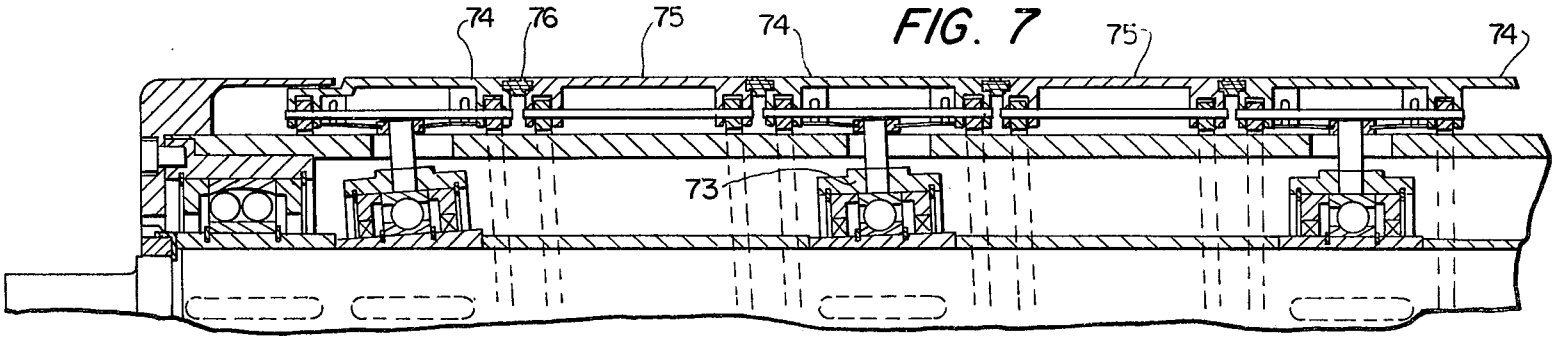
FIG. 7 is a fragmentary longitudinal section of a still further modified cylinder-segment construction.

FIG. 7 is the fragmentary sectional view of a still further modified form of a spreader roll embodied in this invention. Similarly to the arrangement illustrated on FIG. 6, this construction comprises a plurality of annular carriages 73 located at intermediate points within the length of the spreader roll 1 controlling the oscillating motion of the cylinder segments. However, for expediency in manufacture and contrary to the arrangement of FIG. 6, the construction illustrated on FIG. 7 does not provide a full array of annular carriages 64 having each and all of the cylinder segments engaged directly with an annular carriage 73. Instead, annular carriages 73 are arranged at intervals of two, three or more cylinder segment spaces. The number and the spacing of the intermediate annular carriages 73 is determined by considering spreader roll dimensions and operating speed.

The cylinder segments 74, 75 shown on FIG. 7 are a further modified form embodied in this invention. The longitudinal spaces between adjacent cylinder segments 74, 75 are filled in with elements 76 made out of an elastomer, which are bonded to the opposite ends of adjacent cylinder segments 74, 75. The elastomer elements 76 take the place of extension-springs, and their presence allows the segment rows to be pretensioned. In addition, the elastomer elements 76 serve as an effective seal between the cylinder segments by preventing particles from the web, dirt, and other foreign material from penetrating the spreader roll surface and collecting in the spaces between adjacent cylinder segments 74, 75. The cylinder elements 74 are shown to be engaged with the annular carriages 73. The transformation of the wobbling motion of the annular carriages 73 into linear oscillating motion of the cylinder elements 74 is accomplished similarly as prescribed previously. The cylinder segments 75 typically are shown located in an intermediate position, in this position they are not directly engaged with an annular carriage 73. Nevertheless, during operation the cylinder segments 75 are, through the spring forces of elements 75, subjected to motions which are harmonic with the motions of the directly engaged cylinder segments 74 to the left and to the right respectively, and the oscillating amplitudes of the intermediate segments are at prorated rates respective to the amplitudes of the segments 74.

Figure 8:
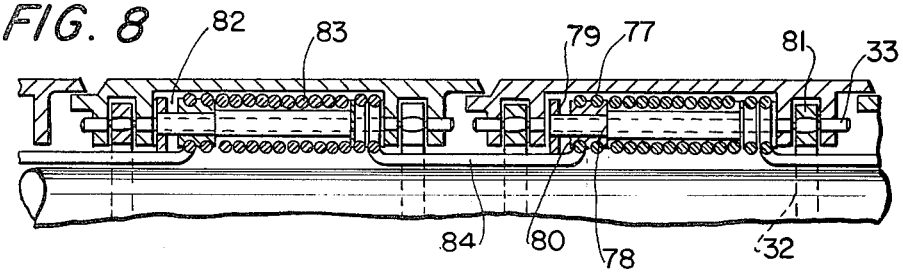
FIG. 8 is a longitudinal sectional view of one form of cylinder-segment arrangement with the cylinder elements shown in contracted position.
Figure 8A:
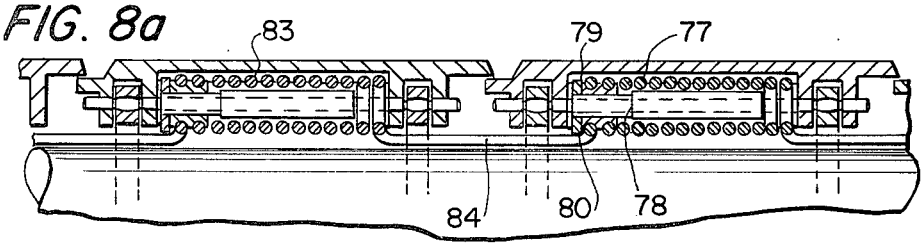
FIG. 8*a* is a longitudinal sectional view similar to FIG. 8, but with the cylinder elements shown in extended position.

FIG. 8 is a longitudinal sectional view of one form of cylinder segment arrangement with the cylinder segments 5 shown in the position of maximum contraction. In this form of embodiment of this invention, the forces imposed by the pretensioned cylinder segment rows and the inertias of the segments in oscillating motion are here transmitted entirely through a mechanical spring-and-rod system, which extends longitudinally to the opposite ends of the spreader roll body and with the spring-and-rod system having its opposite ends securely anchored to the annular carriages 18, 40, 64 over flexible coupling elements, as has been described previously. The spring-and-rod system consist of evenly spaced tensionspring units which are connected with each other thru articulated rods 84. The individual spring units are constructed to fit into the inside structure 82 of the cylinder elements 5 and to thus be engaged with each other in a longitudinal direction. The elements are then secured to the spring-units with pins 33, as previously described. The spring-units comprise pretensioned tension springs 83, spring guides, and stops to limit the total possible movements. The stops 77, 78 limit the maximum contraction possible between two adjacent cylinder elements 5, while the stops 79, 80 limit the maximum extension. FIG. 8 shows a fragmentary section of a cylinder segment row in the fully extended position.

Figure 9:
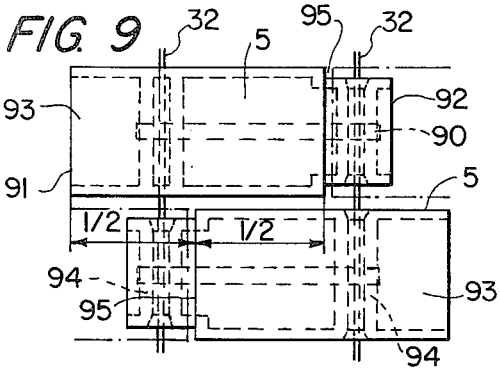
FIG. 9 is a plan view of two adjacent cylinder-segments.

In FIG. 9, a plan view is given of a form of two adjacent cylinder segments 5, both of identical construction and arranged side by side in the direction of travel. They are placed in a reversed position in relation to each other. The lugs 94, which are an integral part of the cylinder segments and serve to receive the pins used for the attachment of the cylinder segments 5 to the retaining rings 32, have in this construction been placed on the cylinder segment bodies to permit the arranging of alternatingly reversed cylinder segments into individual segment rings. The cylinder segment ends 91, 92 seen longitudinally, are formed to slide into each other, thereby preventing open spaces between segments where particles of the web or foreign material could collect. This special arrangement of alternatingly reversed cylinder segments has the advantage of first eliminating the presence on the roll surface of a continuous separation groove 95 in direction of travel, which otherwise would cause quality deficiencies in the web material and secondly of improving the uniformity of spreading action still further and effectively smoothing out the step-wise spreading action from one cylinder element to the other.

Figure 10:
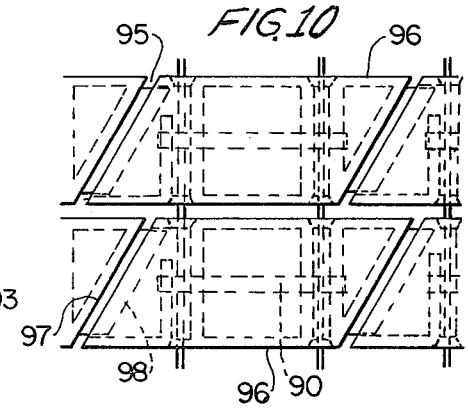
FIG. 10 is a plan view similar to FIG. 9, but with cylinder-segments of alternate structural form.

FIG. 10 is a plan view of another form of adjacent cylinder segments 96, both of identical construction and again arranged side by side as part of a segment-ring as described previously. The cylinder segment ends 97, 98, seen longitudinally, are formed to slide into each other as before (FIG. 9). However, here the ends 97 and 98 are constructed at a bias to achieve a discontinuity of the separation groove in direction of travel. Or, instead of at a bias, the cylinder segment ends 97, 98 can also be formed in a curvature with the opposite ends 97, 98 fitted together in close engagement. The advantages of this construction are the same or similar as described previously in reference to FIG. 9.

Figure 11:
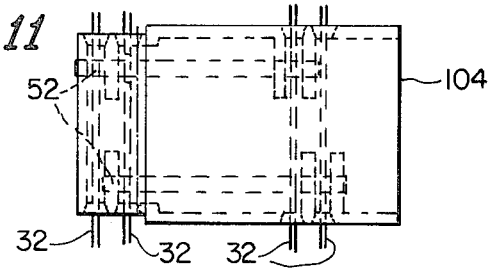
FIG. 11 is a plan view of a single cylinder-segment similar to FIG. 9, but of alternate structural form with four anchor points instead of two.

FIG. 11 is a plan view of a cylinder segment 104 which is of similar construction as the cylinder segments 5 of FIG. 9, except here the cylinder segment is of greater width in the direction of travel. This applies to spreader rolls where a total of six or eight cylinder segment rows are used on the full circumference. The segment 104 has a two-pin anchorage and is mounted on four retaining rings 32, as it has been described previously with reference to FIG. 3.

Figure 12:
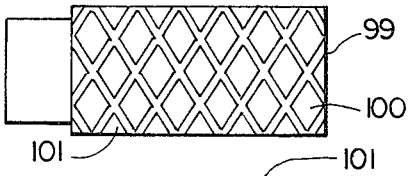
FIG. 12 is a plan view of a single cylinder-segment with a structured outside surface.
Figure 12A:
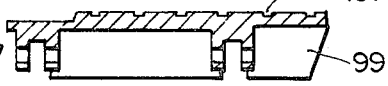
FIG. 12*a* is a longitudinal section of the cylinder-segment of FIG. 12.

FIG. 12 and FIG. 12*a* are a plan view and a sectional view of a cylinder segment 99. This construction of a cylinder segment differs from previous forms by having the surface 100 which comes in web-contact structured 101. Biased grooves which are part of the structured surface shown allow the escape of air which otherwise tends to form an aerodynamic wedge between web and roll surface at high operating speeds and prevents an intimate contact between web and roll surface. Such a contact is required if the spreading action of the spreader roll surface is to be transmitted fully to the travelling web.

Figure 13:
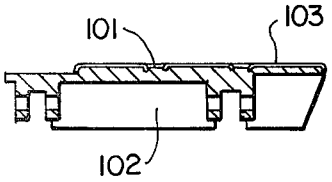
FIG. 13 is a longitudinal section of a cylinder-segment with an armored outside surface.

FIG. 13 is a sectional view of a still further modified cyclinder segment 102 embodied in this invention. The surface of the cylinder segment 102 is here provided with a thin shield of armor. The shields can be equipped with or without air escapement grooves 101. The shields 103 can be attached to the cylinder segment surface during the manufacture of the segments while being cast of plastic material or metal, or have them attached thereto in a secondary operation. Since a key, set in a groove in the surface of the sleeve 17 and longitudinally extending, is provided between two adjacent cylinder segment rows on the roll, and all cylinder segments are held at a fixed distance to each other in the direction of travel thru their anchorage with the retaining rings, the cylinder elements are all aligned in straight rows and in a direction parallel to the roll axis. The cylinder segments within the rows can be moved together or apart to a limited extent. The measure of relative movement of two longitudinally adjacent segments, divided into the total distance between the centers of two adjacent segments, equals the degree of spreading. It is to be noted that the movements of the segments relative to the roll body are cumulative, starting from the stationary segments at the center of the roll length, and add up toward the two opposite roll ends. As an example, a spreader roll with a spreading degree of 1 percent and a segment-to-segment distance of 100 mm, thus having a relative movement of 1 mm between two adjacent segments, will at the tenth segment, counted from center of the roll toward the roll ends, have a total movement of 10 mm; likewise at the eleventh segment it will have a total movement of 11 mm, etc. With each revolution, repeating movements of the segments can be imposed upon the segments individually thru equally spaced carriages rotating angularly disposed as integral parts of, and inside, the roll structure, the movements being transmitted with follower pins reaching from the carriages to the segments through apertures provided for in the roll sleeve. Or, the movements can be imposed upon the segments through carriages, one of each located at the opposite ends of the roll and rotating angularly disposed to each other and to the roll axis as integral parts of, and inside of, the roll structure, the movements being transmitted by having the opposite ends of the segment rows flexibly connected to the carriages.

For the latter, the movements imposed on the segment-row ends can advantageously be transmitted to the full array of segments within each row by having the longitudinally adjacent segments connected to each other with pretensioned springs, all of them of identical elastic characteristics.

In addition to having springs integrated with all of the longitudinal connections between adjacent segments, in this form of embodiment of the invention, suitable means are provided to limit to a predetermined degree the extent of the movements relative to each other of each adjacent segment pair. This insures that, for instance during the elongation phase, which is the working phase of the spreader roll, none of the segments can be pulled away from its adjacent neighbor beyond these limits, should the movement toward the roll ends be resisted by forces exerting themselves on the opposite side, the side toward the center. The danger of nonuniform spreading action, in particular of a greater spreading rate on the outside than on the inside sections of the roll because of accumulating friction forces, is here eliminated by a forceful distribution of equal partial movements to each segment pair. The limit stops built into the segments permit the use of pretensioned springs which cause the adjacent segments moved together into the contracted position with clearly defined spring forces. The spring forces do not diminish at the contractural stop positions. They continue to momentarily press the segments together under live pressure. The use of relatively forceful springs is thereof possible, and they, in combination with the clearly defined stopped-movements of the segments, make operation at high speeds possible without the danger of bringing the segments into an uncontrollable vibrational resonance.

An equal and uniform distribution of the longitudinal movements as measured by the distance between adjacent segments within each of the individual parallel segment rows, at every rotational position within a full revolution, can be accomplished by the interactions of the segment stops and retaining rings alone without the additional aid of pretensioned springs.

The segments of a segment-row, while passing the rotational position of maximum expansion, are momentarily fixed at equal distances to each other, since the segments at this instant have been drawn out fully and come to rest against the extension stops. The segments passing at this instant the position of maximum contraction, which is 180° opposite the above, are momentarily fixed at equal distances to each other also, by having been pushed together all the way and coming to rest aginst the contraction stops. The longitudinal positioning of the segments in relation to each other during the intermediate path between the defined extreme positions is here taken over fully by the longitudinal steering action of the retaining rings, which rotate at an angle of disposition relative to the axis, the angle being defined by the attached segments extreme positions of expansion and contraction. The angles of disposition of the retaining rings change from one segment-ring to the other. These angles increase from the roll center, where they are zero, at a linear progressive rate toward the end-segment, where the angle of disposition is at its maximum. Assisting the retaining rings in maintaining the thus enforced angles of disposition are the inertia forces born with the rotating rings, which react with counterforces against any angular changes of the axis of rotation.

The anchorage of the segments on the retaining rings with metal-pins passed thru the concentrically arranged and evenly spaced holes of the retaining rings makes it possible to provide ample and well defined clearance between segment bases and roll-sleeve surface. With the centrifugal forces acting upon the segments, they will be suspended in space during rotation and, with only incidental contacts to the roll-sleeve, will float upon the outer roll surface with substantial freedom to longitudinal motions.

The various methods of manufacturing of the cylinder elements which are possible with the present invention's construction of cylinder elements permit the addition to the cylinder element construction of features which are particularly unique in the application of the spreader rolls. The surface of the segments which come in contact with the web can be structured to any design to serve a given purpose. It is known, for instance, that at high speeds air is drawn into a converging nip formed between a smooth surfaced rotating roll and a travelling web and tends to form an aerodynamic wedge which will partially or fully lift the web from direct contact with the roll surface, with the air in the thin intervening space acting as a lubricant. The transmission of forces between roll surface and web under such conditions is nearly impossible, and therefore a spreader roll with a smooth surface almost entirely loses its intended effect on a web a high speeds. This drawback of smooth-surfaced rolls at high speeds can be eliminated by providing a sufficient number of air-escape passages on the surface of a roll. These passages can be grooves cut into the surface in the direction of travel or at a bias. The construction of the segments in accordance with this invention permit the provision on the segment surface of many different types of air passages.

In addition, segment surfaces can be made sculptured in repetitive patterns to make such segments particularly well suited for transmission of spreading forces upon webs which tend to afford too little friction resistance to moving smooth surfaces. And finally, the segment surfaces can be provided with a thin shield of armor, e.g. metal cladding, for applications with high-abrasive service. Such shields are advantageously bonded to the segment bodies during the manufacturing, or the surfaces of a premanufactured segment can be metal-plated by a galvanic process for improved abrasional resistance.

Operation of spreader rolls in accordance with this invention has shown that segments as long as 100 mm in the direction of the roll length can be used for smooth spreading of even the very light and thin papers, and that non-uniformities due to a stepwise spreading, if present at all, cannot be identified as such. The stepwise characteristic of spreading is smoothed out still further with the construction of this invention by alternatingly reversing the segments, which achieve a spreading effect of halflength segments, or placing the separation lines between adjacent segments at a bias.

Straight spreader rolls of the construction according to this invention can be installed in very compactly arranged webprocessing machines. They can be installed in a machine and operated with the spreader rolls actually contacting the next following web supporting roll, which is of particularly great advantage on wind-up machines for thin web-material. Further, spreading rolls of the construction according to this invention can be operated with varying degrees of webcontact angles. Changes in a existing machine set-up of web-contact angles within the range of 10° to 180° can be made without causing secondary web-handling problems. However, it should be noted, that the spreading effect starts to diminish at contact angles of 120° and above.

To be able to take full advantage of the improvements that straight spreader rolls can bring to web-process machines, the spreader rolls must be designed and constructed in every engineering and operational respect to withstand the demands brought on by today's machines of great widths and operating speeds.

I claim:

1. A spreader roll for processing machines of the type used in the paper, textile and plastics industries, comprising a stationary shaft;

a carrier roll rotatably mounted on said shaft; a cylindrical roll body mounted about said shaft to rotate with said carrier roll, said roll body formed of a plurality of rigid cylinder-segments;

means for arranging said cylinder-segments about said carrier roll in parallel rows along the mantel lines of said roll body and for interconnecting said cylinder-segments to permit said cylinder-segments to move relative to each other and to have interdependent torque within said rows, said means comprising a plurality of separate, substantially rigid ring elements which encircle said carrier roll and hold said cylinder-segments in a radial direction, said ring elements being spaced from said carrier roll and freely movable relative thereto;

control means for moving said cylinder-segments mounted on said shaft to rotate with and inside of said roll body, the ends of said cylinder-segment rows being coupled to said control means;

whereby said cylinder-segments may be moved back-and-forth in a direction parallel to the longitudinal axis of said roll body upon rotation of said roll body, which movement being repeated with every revolution of said roll body.

2. A spreader roll according to claim 1, wherein said interconnecting means includes stop means located longitudinally between said cylinder-segments of each row for limiting movement therebetween in a predetermined manner.

3. A spreader roll according to claim 1, wherein said interconnecting means includes spring means located longitudinally between said cylinder-segments of each row for resiliently biasing said cylinder-segments toward a predetermined position.

4. A spreader roll according to claim 1, wherein said control means comprises a plurality of annular carriages rotatably mounted on said shaft, orientated at angles relative to the longitudinal axis of said roll body, located within said carrier roll, and distributed over the length of said roll body.

5. A spreader roll according to claim 1, wherein said control means comprises annular carriages rotatably mounted on said shaft, orientated at a non-perpendicular angle relative to the longitudinal axis of said roll body, and located adjacent the opposite ends and inside of said carrier roll.

6. A spreader roll according to claim 5, wherein each said annular carriage is supported on spherical bearings having bearing races which are secured against rotation relative to each other.

7. A spreader roll according to claim 6, wherein said bearing races have mating bevel gears provided therebetween and to secure against rotation relative to each other.

* * * * *